US009048605B2

(12) United States Patent
Hutchfield et al.

(10) Patent No.: US 9,048,605 B2
(45) Date of Patent: Jun. 2, 2015

(54) HAND OPERATED CRIMPING TOOL

(75) Inventors: John Hutchfield, Sudbury (GB); Niklas Jonasson, Mora (SE)

(73) Assignee: Pressmaster AB, Alvdalen (SE)

( * ) Notice: Subject to any disclaimer, the term of this patent is extended or adjusted under 35 U.S.C. 154(b) by 512 days.

(21) Appl. No.: 13/447,410

(22) Filed: Apr. 16, 2012

(65) Prior Publication Data

US 2012/0284983 A1 Nov. 15, 2012

(30) Foreign Application Priority Data

May 13, 2011 (SE) ..... 1100365

(51) Int. Cl.
*B25B 27/14* (2006.01)
*H01R 43/042* (2006.01)

(52) U.S. Cl.
CPC ..... *H01R 43/042* (2013.01); *Y10T 29/539* (2013.01)

(58) Field of Classification Search
USPC ..... 29/268, 749, 751, 753; 72/473, 477, 72/409.11, 413, 480, 409.16, 409.1; 7/107
See application file for complete search history.

(56) References Cited

U.S. PATENT DOCUMENTS

| | | | | |
|---|---|---|---|---|
| 3,571,888 | A | 3/1971 | Di Filippo | |
| 4,571,764 | A * | 2/1986 | Chen et al. | 7/107 |
| 4,926,685 | A * | 5/1990 | Shannon, Sr. | 72/409.11 |
| 5,802,908 | A | 9/1998 | Frenken | |
| 7,237,426 | B2 * | 7/2007 | Baker et al. | 72/409.16 |
| 8,578,751 | B2 * | 11/2013 | Hofmann | 72/409.16 |

* cited by examiner

*Primary Examiner* — Lee D Wilson
*Assistant Examiner* — Henry Hong
(74) *Attorney, Agent, or Firm* — Dickstein Shapiro LLP

(57) ABSTRACT

A hand operated crimping tool comprising a body arranged between a distal end and a proximal end of the crimping tool, a tool head arranged distally on the crimping tool, and handles arranged proximally on the crimping tool, which handles are movably arranged in relation to each other, where at least one handle is movably arranged in relation to the body, where two crimping dies between which at least one workpiece is to be crimped form a die pair, and where the relative movement of the tool handles is connected to the relative movement of crimping dies forming at least one die pair. The crimping tool comprises at least three crimping dies, the crimping dies forming at least two die pairs, where the distances between the respective crimping dies in at least two die pairs are further arranged adjustable independently of each other.

17 Claims, 5 Drawing Sheets

HAND OPERATED CRIMPING TOOL

FIELD OF THE INVENTION

The present invention relates to a hand operated crimping tool.

BACKGROUND OF THE INVENTION AND RELATED ART

When crimping, a connector i.e. a terminal, splice, contact or a similar device is mechanically secured to at least one cable—e.g to a conductor such as a wire—by deformation so that a solid joint having reliable mechanical and electrical connection is formed. The crimping operation resulting in a crimped joint is performed using crimping dies. Crimping tools may e.g. be hand operated.

In hand operated hand held crimping tools, the crimping tool is usually arranged with two proximally on the crimping tool arranged handles which are movable in relation to each other, where when the user brings the handles towards each other using hand force, usually using one hand only which when placed around both of the handles is squeezed together, the usually distally on the crimping tool arranged crimping dies are brought together in order to crimp at least one workpiece between them.

When the workpiece to be crimped is crimped at two positions having different cross-sectional dimensions, e.g. when crimping an open barrel connector to a conductor where the connector at one position encloses the conductor only and at the other position encloses both the conductor and the isolation surrounding the conductor, two crimping operations have to be performed when using a crimping tool having only one pair of standard crimping dies.

In order to be able to crimp a workpiece of the above kind with only one crimping operation, the PRESSMASTER© crimping tool KRB 0560 with partnr. 4300-1622 comprises a die set comprising two crimping dies adapted to the two different cross-sectional dimensions.

SUMMARY OF THE INVENTION

The primary object of the present invention is to provide an improved hand operated crimping tool.

The above mentioned object is achieved for a hand operated crimping tool where the relative movement of the tool handles is connected to the relative movement of crimping dies forming at least two die pairs in which at least one workpiece is arranged to be crimped, where the distances between the respective crimping dies in at least two die pairs further are arranged adjustable independently of each other, as stated in the characterizing portion of claim 1, the crimping tool thus being adaptable to workpieces with at least two cross-sectional dimensions having different combinations of the at least two cross-sectional dimensions.

According to one embodiment, the distances between the respective crimping dies in at least two die pairs are arranged adjustable independently of each other by that at least one crimping die in each of the die pairs is arranged separately adjustable.

According to one embodiment, the respective adjustable crimping dies are each arranged adjustable by a separate adjusting mechanism arranged at the tool head, where the respective adjusting mechanism comprises an at the tool head arranged respective adjusting screw arranged to adjust the position of the respective adjustable crimping die.

According to one embodiment, the respective adjusting screws are, seen in the axial direction of the respective adjusting screw, arranged axially fixed and angularly freely movable to the tool head.

According to one embodiment, each of the adjusting screws are arranged in a respective threaded hole arranged in the respective adjusting element these being further connected to the respective crimping die at the die face facing away from the other crimping die in the respective die pair by mechanically interlocking guiding recesses arranged in the respective adjusting element and the respective crimping die.

According to one embodiment, the respective adjusting screws extend at an angle to the extension of the respective guiding recesses whereby the rotation movement of the respective adjusting screw is transferred to a translation movement of the respective adjustable crimping die via a translation movement of the respective adjusting element.

According to one embodiment, crimping dies forming a die pair are arranged at the body and the tool head, respectively, and that the tool head is arranged movable in relation to the body.

According to one embodiment, a tool head guiding part and thus the tool head is arranged slidably attached to the body using pins arranged to slide in at slots extending axially along the tool.

According to one embodiment, at least one pivotable handle is pivotably attached to the body.

According to one embodiment, the body comprises two body parts between which a tool head guiding part is arranged.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
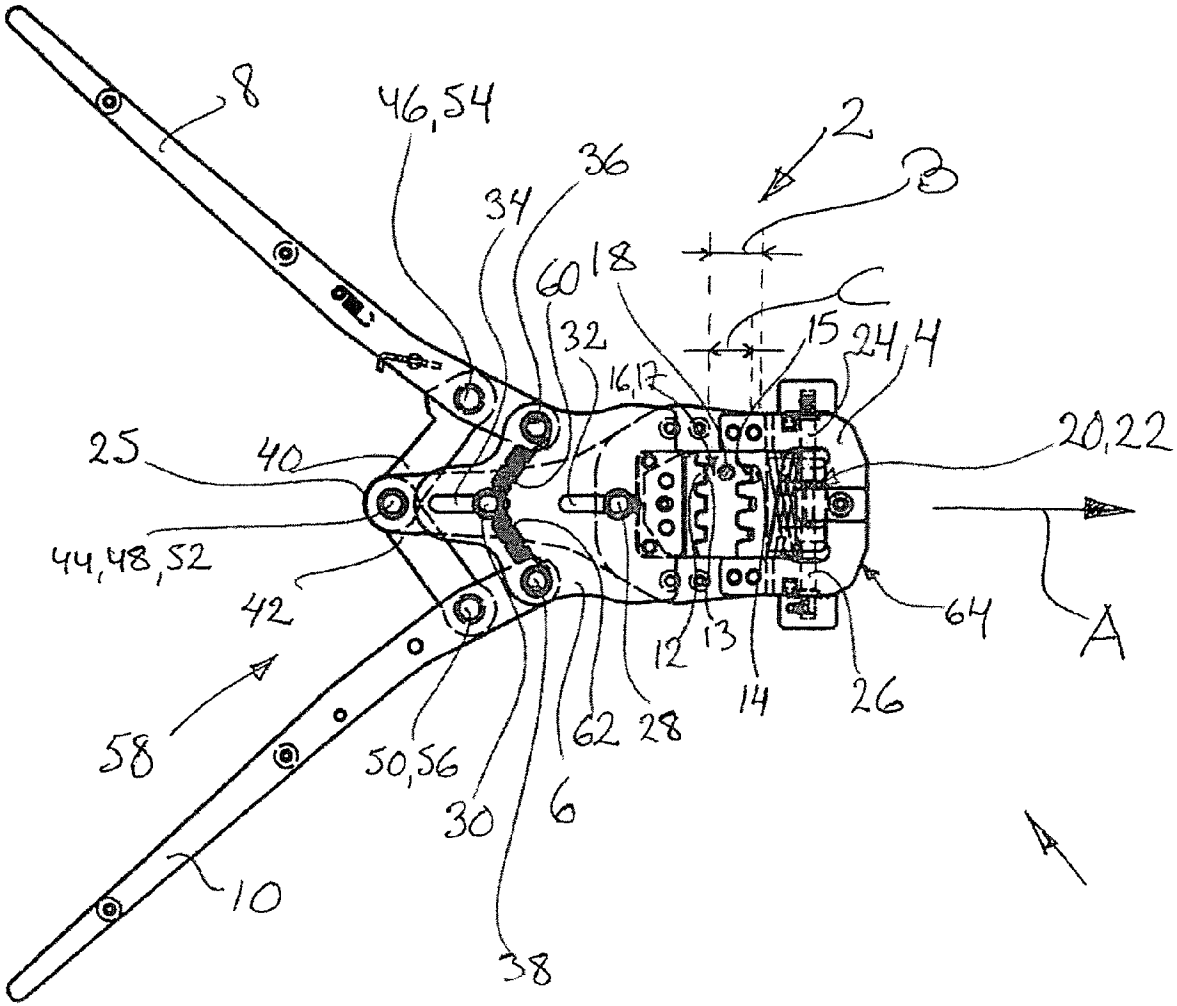
FIG. 1 shows schematically a side view of a hand operated crimping tool according to a first embodiment of the invention, shown in a non-crimping position.

The same reference numerals are being used for similar features in the different drawings.

FIG. 1 shows schematically a side view of a hand operated crimping tool 2 according to a first embodiment of the invention, shown in a non-crimping position. The crimping tool 2 comprises a tool head 4, a body 6 and two handles 8, 10 which handles 8, 10 are movably arranged in relation to each other. The body 6 is arranged between the distal end 1 and the proximal end 3 of the crimping tool 2. The tool head 4 is arranged distally 1 on the crimping tool 2, and the two handles 8, 10 are arranged proximally 3 on the crimping tool 2. Two crimping dies 12, 14; 13, 15 between which at least one workpiece 18 is to be crimped when said crimping dies 12, 14; 13, 15 move towards each other form a respective die pair 16; 17. In this embodiment both handles 8, 10 are pivotally arranged to the body 6, and the relative movement of the tool handles 8, 10 is connected to the relative movement of crimping dies 12, 14; 13, 15 forming a die pair 16; 17 in which at least one workpiece 18 is arranged to be crimped.

Several die pairs 16, 17 may make use of the same crimping die, e.g. one of crimping dies 12 and 13 may be arranged sufficiently wide to form one die of both die pairs 16, 17. The crimping tool 2 thus comprises at least three crimping dies 12, 13, 14, 15, the crimping dies 12, 13, 14, 15 forming at least two die pairs 16, 17, where the distances B; C between the respective crimping dies 12, 14; 13, 15 in at least two die pairs 16; 17 further are arranged adjustable independently of each other.

According to this embodiment, the distances B; C between the respective crimping dies 12, 14; 13, 15 in at least two die pairs 16; 17 are arranged adjustable independently of each other by that at least one crimping die 14, 15 in each of the die pairs 16, 17 is arranged separately adjustable as will be described in more detail below. The respective independently adjustable crimping dies 14, 15 are each arranged adjustable by a respective separate adjusting mechanism 20, 22 arranged at the tool head 4, where the respective adjusting mechanism 20, 22 comprises an at the tool head 4 arranged axially fixed but angularly freely movable respective adjusting screw 24, 26 arranged to adjust the position of the respective adjustable crimping die 14, 15 as will be described in more detail below.

As mentioned above, the relative movement of the tool handles 8, 10 is connected to the relative movement of the crimping dies 12, 14; 13, 15, which according to this embodiment is achieved by that the tool head 4 comprises a head guiding part 25 arranged to extend along the body 6 and being slidably attached to the body 6 using pins 28, 30 arranged to slide in respective slots 32, 34 extending axially A along the tool 2, where preferably at least two pins 28, 30 are used in order to control the movement of the head guiding part 25 relative to the body 6. The slots 32, 34 may be arranged in the body 6 or in the head guiding part 25, and the pins may be arranged in the head guiding part 25 or in the body 6, respectively. The handles 8, 10 are pivotably attached to the body 6 at pivot points 36, 38. The handles 8, 10 are further connected to the head guiding part 25 by respective toggles 40, 42 which toggles 40, 42 are pivotably attached to the head guiding part 25 and a respective handle 8, 10 at pivot points 44, 46; 48, 50, preferably by using pins 52; 54, 56. The relative movement of the pivotally to the body 6 arranged handles 8, 10 is thus arranged connected to the movement of the head guiding part 25 and thus to the movement of the tool head 4 by a mechanism 58, here a toggle mechanism. The head guiding part 25 is arranged axially A slidable along the body 6. The relative movement of the tool handles 8, 10 thus is connected to a relative movement between the tool head 4 and the body 6. The crimping dies 12, 13, 14, 15 are further, preferably removably in order to be exchangeable, arranged at the body 6 and the tool head 4, respectively, by respective fastening elements such as screws.

As can be seen in the figure, at least one return spring 60, 62, in this embodiment two return springs 60, 62 are shown, may be arranged to move the tool handles 8, 10 apart when the force pressing the tool handles 8, 10 towards each other is released, thus moving the distal end 64 of the tool head 4 away from the body 6.

For better understanding of the invention, the parts of the crimping dies 12, 13, 14, 15 which are obscured e.g. by the body 6 or the tool head 4 are shown with dashed lines in the figure.

Figure 2:
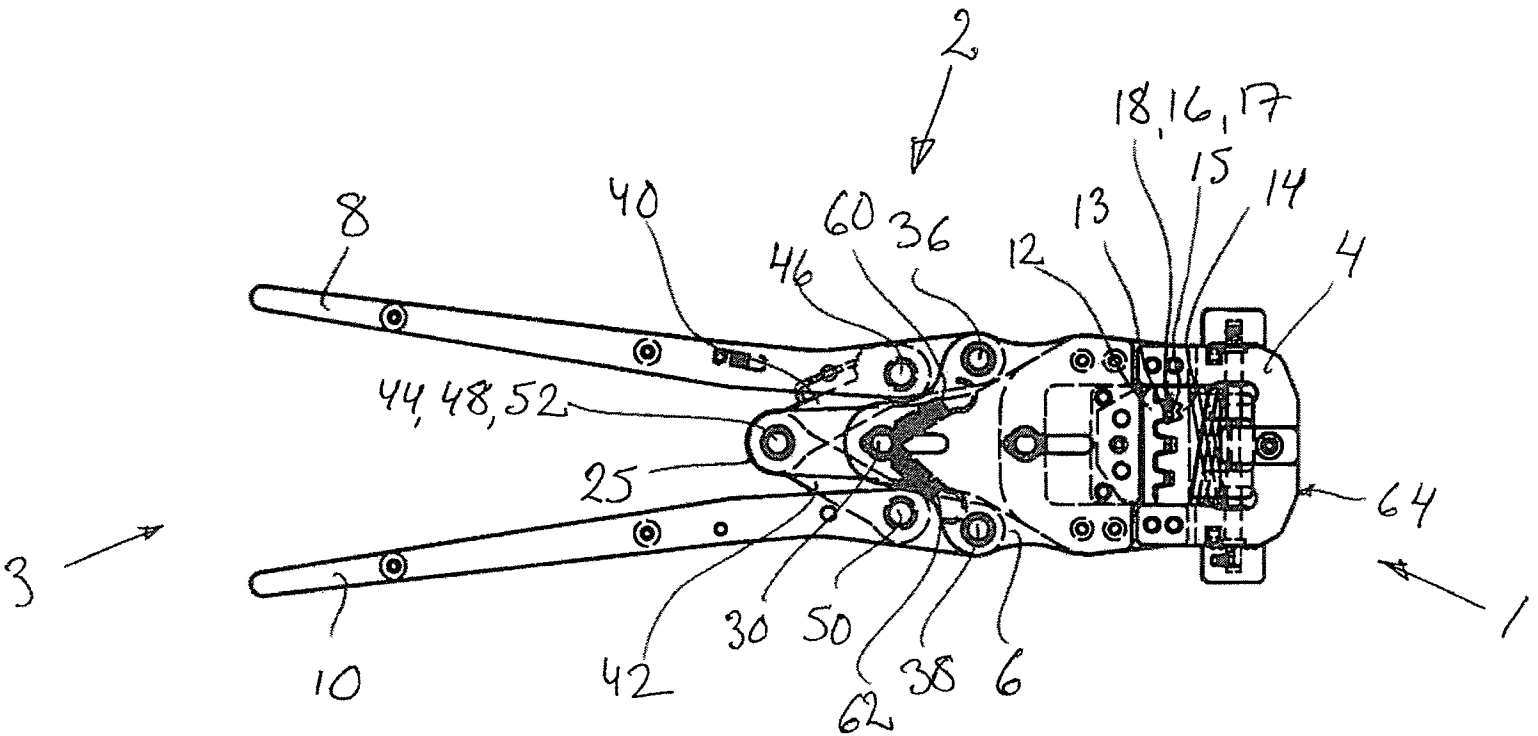
FIG. 2 shows schematically a side view of a hand operated crimping tool according to the first embodiment of the invention, shown in a crimping position.

FIG. 2 shows schematically a side view of a hand operated crimping tool according to the first embodiment of the invention, shown in a crimping position.

As can be seen from FIG. 2 when comparing FIG. 1 with FIG. 2, the crimping dies 14, 15 arranged distally 1 at the tool head 4 are moved between a non-crimping position (as shown in FIG. 1) and a crimping position (as shown in FIG. 2) depending on the position of the tool handles 8, 10 arranged proximally 3 on the crimping tool 2, as the relative movement of the handles 8, 10 is connected to the movement of the tool head 4 via the movement of the head guiding part 25. This is accomplished by arranging the head guiding part 25 axially slidable along the body 6, by arranging the handles 8, 10 pivotally to the body 6, and by connecting the respective handles 8, 10 to the head guiding part 25 via respective toggles 40, 42 pivotally arranged to the head guiding part 25 and to the respective handles 8, 10, as has been discussed in connection with FIG. 1.

When the handles 8, 10 are pressed together, the handles 8, 10 pivot around their respective pivot point 36, 38 arranged on the body 6, whereby the toggles 40, 42 pivot around their respective distal pivot point 46, 50 arranged on the respective handle 8, 10, thereby moving their respective proximal pivot point 44, 48 where they are pivotally attached to the head guiding part 25 proximally along the crimping tool 2, thus moving the distal end 64 of the tool head 4 proximally along the crimping tool 2 towards the body 6. This results in that the distal crimping dies 14, 15 arranged at the tool head 4 are moved by a toggle mechanism towards the proximal crimping dies 12, 13 arranged at the body 6, the crimping dies 12, 14; 13, 15 thus being arranged to be brought towards each other in order to crimp at least one workpiece 18 between the crimping dies 12, 14; 13, 15.

When the head guiding part 25 moves proximally along the body 6, the possible return springs 60, 62 arranged between the head guiding part 25 and the body 6, e.g. arranged between a pin 30 arranged on the head guiding part 25 and a respective pin 36, 38 arranged on the body 6, are tensioned thereby increasing a return spring force trying to move the tool handles 8, 10 apart. Thus, when the force pressing the tool handles 8, 10 towards each other is released, the return spring force from the tensioned return springs 60, 62 is arranged to move the tool handles 8, 10 apart thus moving the distal end 64 of the tool head 4 in the opposite direction away from the body 6. Thus, when parting the tool handles 8, 10, the tool head 4 moves in the opposite direction, i.e. from the position shown in FIG. 2 towards the position shown in FIG. 1. This parting of the handles 8, 10 may optionally be executed manually by the user if no return spring is used.

Figure 3:
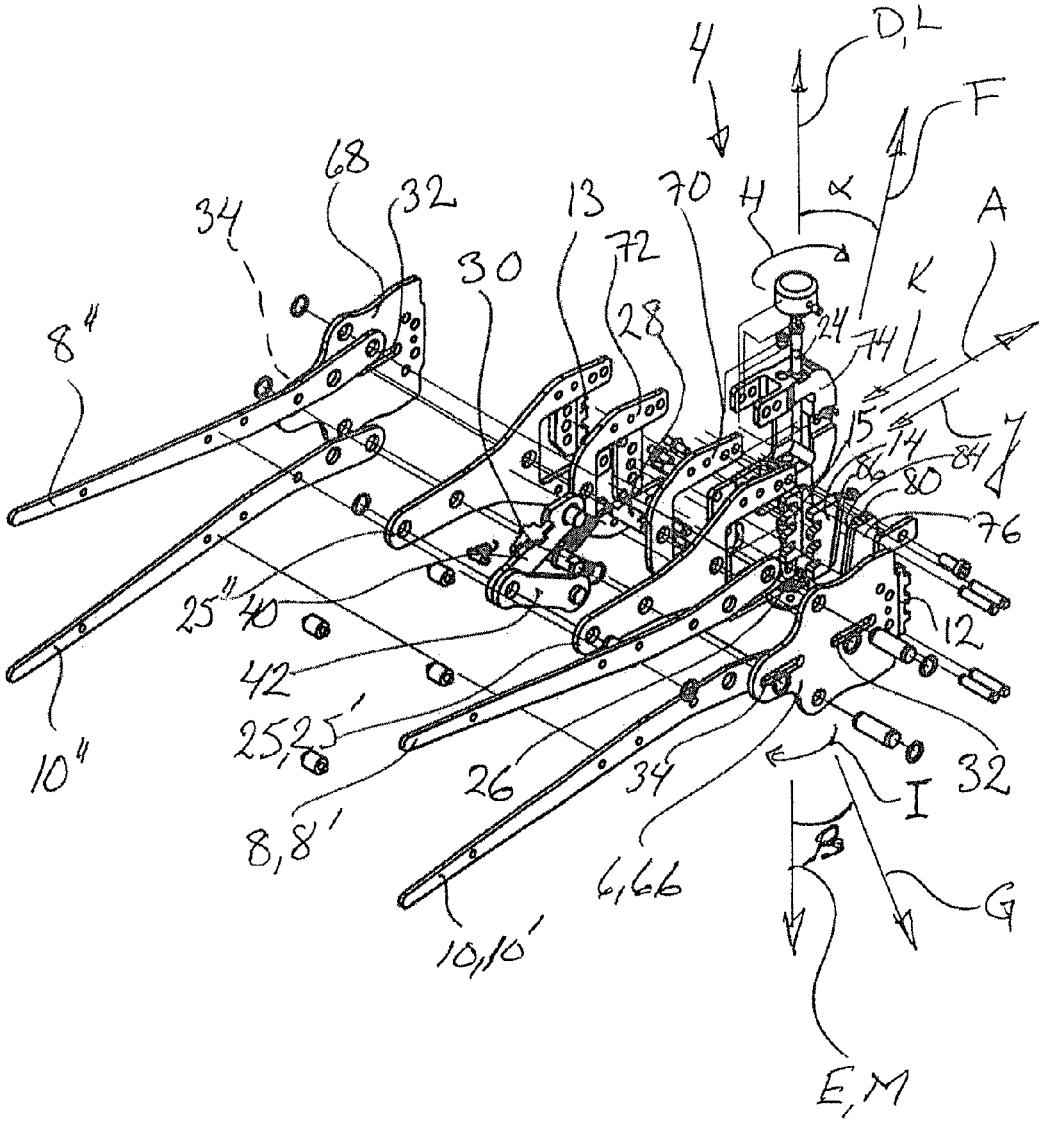
FIG. 3 shows schematically an exploded view of a hand operated crimping tool according to the first embodiment of the invention, shown in a crimping position.

FIG. 3 shows schematically an exploded view of a hand operated crimping tool according to the first embodiment of the invention, shown in a crimping position.

As is shown in the figure, the body 6 preferably comprises two body parts 66, 68 between which the head guiding part 25 of the tool head 4 is arranged to slide.

As can be seen in FIG. 3, e.g. the handles 8, 10 and/or the head guiding part 25 may comprise a number of, preferably plate-like, sub-parts. E.g., a handle 8; 10 may comprise two sub-parts 8', 8"; 10', 10", and the head guiding part 25 may comprise at least two sub-parts 25', 25" between which toggles 40, 42 may be arranged.

The tool head 4 may in addition to the head guiding part 25 comprise more sub-parts 70, 72, 74, here shown as essentially U-shaped sub-parts.

The head guiding part 25 is preferably slidably attached to both body parts 66, 68 of the body 6, e.g. by using pins 28, 30 attached to the head guiding part 25 and arranged to slide in slots 32, 34 arranged in each of the body parts 66, 68.

As mentioned above, the distances between the respective crimping dies 12, 14; 13, 15 in at least two die pairs are arranged adjustable independently of each other by that at least one crimping die 14, 15 in each of the die pairs is arranged separately adjustable. The independently adjustable crimping dies 14, 15 are each arranged adjustable by a separate adjusting mechanism 20, 22 arranged at the tool head 4, said adjusting mechanism 20, 22 comprising an at the tool head 4 arranged axially fixed but angularly freely movable adjusting screw 24, 26 arranged to adjust the position of the adjustable crimping die 14, 15.

Each of the respective adjusting screws 24, 26 are arranged to adjust the position of an respective adjustable crimping die 14, 15, in this embodiment by adjusting the position of an slidably to the adjustable crimping die 14, 15 arranged respective adjusting element 76, 78.

Each of the adjustable crimping dies 14, 15 are slidably guided in the tool head 4 in the axial direction A of the crimping tool 2, and the adjusting elements 76, 78 are arranged slidably guided in the tool head 4 in the axial direction D, E of, i.e. in this embodiment along, the adjusting screw 24, 26.

In the following, hole 80 and guiding recesses 84, 86 and the die face 82 are shown only for adjusting element 76 and the crimping die 14 in the figure. According to the invention, adjusting element 78 and crimping die 15 are arranged in an analogous, and further preferably vertically inverted as is indicated by the axis F and axis G and also shown in FIG. 4, adjustable way.

Each of the respective adjusting screws 24, 26 are fixed to the tool head 4 seen in the axial direction D, E of the respective screws 24, 26 and are each further arranged in a respective threaded hole 80, 81 in the respective adjusting element 76, 78. The respective adjusting element 76, 78 is connected to the respective die face 82, 83 of the respective adjustable crimping die 14, 15 facing away from the other crimping die 12, 13 in the respective die pair 16, 17 by respective mechanically interlocking guiding recesses 84, 86 arranged in the respective adjusting element 76, 78 and the respective adjustable crimping die 14, 15, which recesses 84, 86 allow relative movement between the respective adjusting element 76, 78 and the respective adjustable crimping die 14, 15 along F, G the respective mechanically interlocking guiding recesses 84, 86, but essentially blocks relative movement between the respective adjusting element 76, 78 and the respective adjustable crimping die 14, 15 in other directions. The respective adjusting screw 24, 26 extends D, E at an respective angle α, β to the respective extension F, G of the respective guiding recesses 84, 86 whereby the respective rotation movement H, I of the respective adjusting screw 24, 26 is transferred to a respective translation movement J, K of the respective adjustable crimping die 14, 15 via a respective translation movement L, M of the respective adjusting element 76, 78.

Optionally, the respective adjusting screws 24, 26 are, seen in the axial direction D, E of the respective adjusting screw 24, 26, arranged axially fixed and angularly freely movable to a to the respective adjustable crimping die 14, 15 arranged respective adjusting element 76, 78, and each of the adjusting screws 24, 26 are arranged in a threaded hole arranged in the tool head 4, and each of the respective adjusting screws 24, 26 are arranged to adjust the position of a respective adjustable crimping die 14, 15 by adjusting the position of a to the adjustable crimping die 14, 15 arranged respective adjusting element 76, 78, and the respective adjusting elements 76, 78 are further connected to the respective crimping die 14, 15 at the die face 82, 83 facing away from the other crimping die 12, 13 in the respective die pair 16, 17 by mechanically interlocking guiding recesses 84, 86; 85, 87 arranged in the respective adjusting element 76, 78 and the respective crimping die 14, 15.

Figure 4:
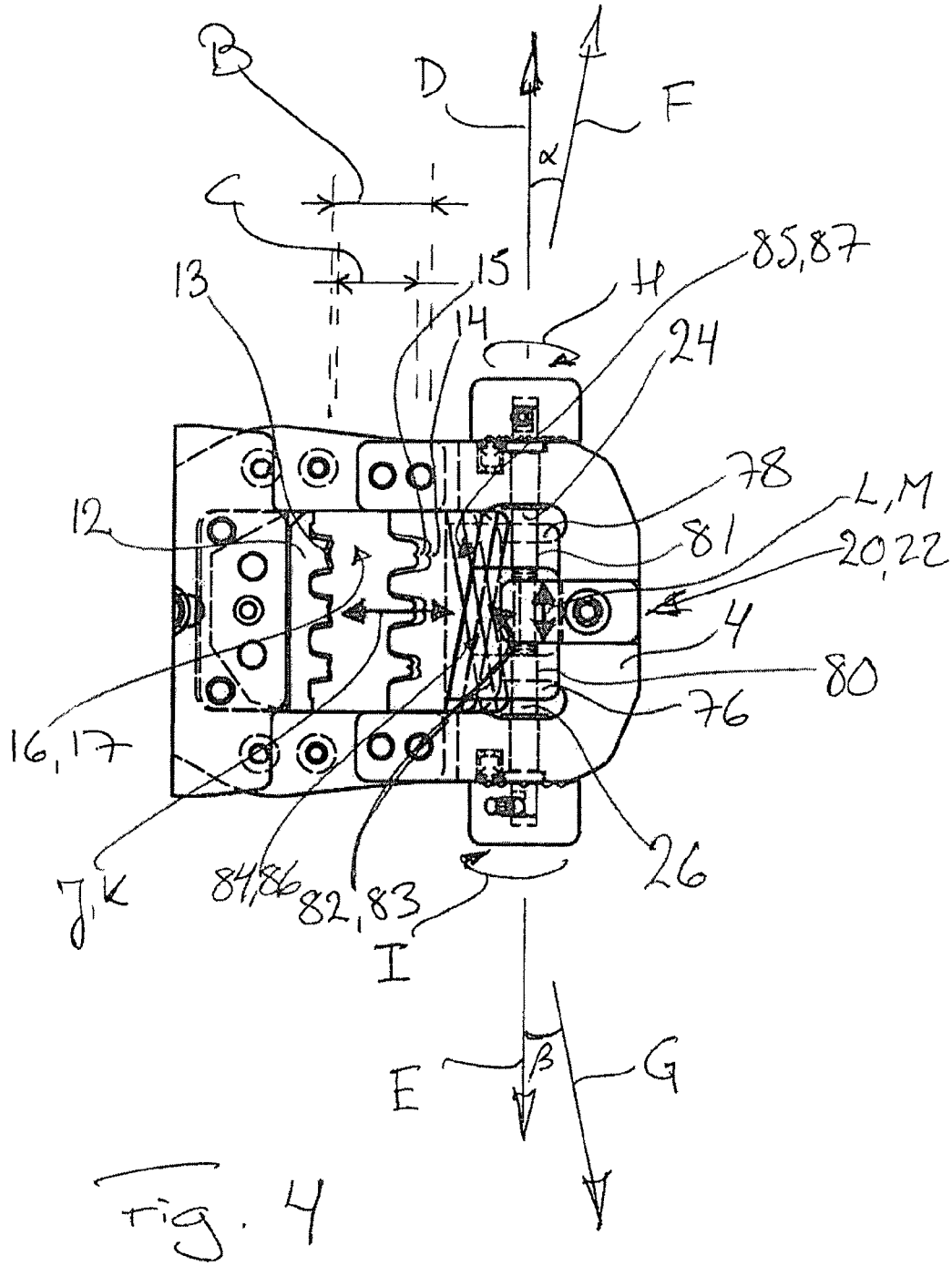
FIG. 4 shows schematically a side view of one of the crimping die adjusting mechanisms according to the first embodiment of the invention.

FIG. 4 shows schematically a side view of one of the crimping die adjusting mechanisms according to the first embodiment of the invention.

According to this embodiment, the distances B; C between the respective crimping dies 12, 14; 13, 15 in at least two die pairs 16; 17 are arranged adjustable independently of each other by that at least one crimping die 14, 15 in each of the die pairs 16, 17 is arranged separately adjustable by a separate adjusting mechanism 20, 22 arranged at the tool head 4, said adjusting mechanism 20, 22 comprising an at the tool head 4 arranged axially fixed but angularly freely movable adjusting screw 24, 26 arranged to adjust the position of the adjustable crimping die 14, 15.

Each of the respective adjusting screws 24, 26 are fixed to the tool head 4 seen in the axial direction D, E of the respective screws 24, 26 and are each further arranged in a respective threaded hole 80, 81 in the a respective adjusting element 76, 78. The respective adjusting element 76, 78 is connected to the respective die face 82, 83 of the respective crimping die 14, 15 facing away from the other crimping die 12, 13 in the respective die pair 16, 17 by respective mechanically interlocking guiding recesses 84, 86; 85, 87 arranged in the respective adjusting element 76, 78 and the respective crimping die 14, 15.

The respective adjusting screw 24, 26 extends at an angle α, β to the extension F, G of the respective guiding recesses 84, 86; 85, 87 whereby the rotation movement H, I of the respective adjusting screw 24, 26 is transferred to a translation movement J, K of the respective adjustable crimping die 14, 15 via a translation movement L, M of the respective adjusting element 76, 78.

Figure 5:
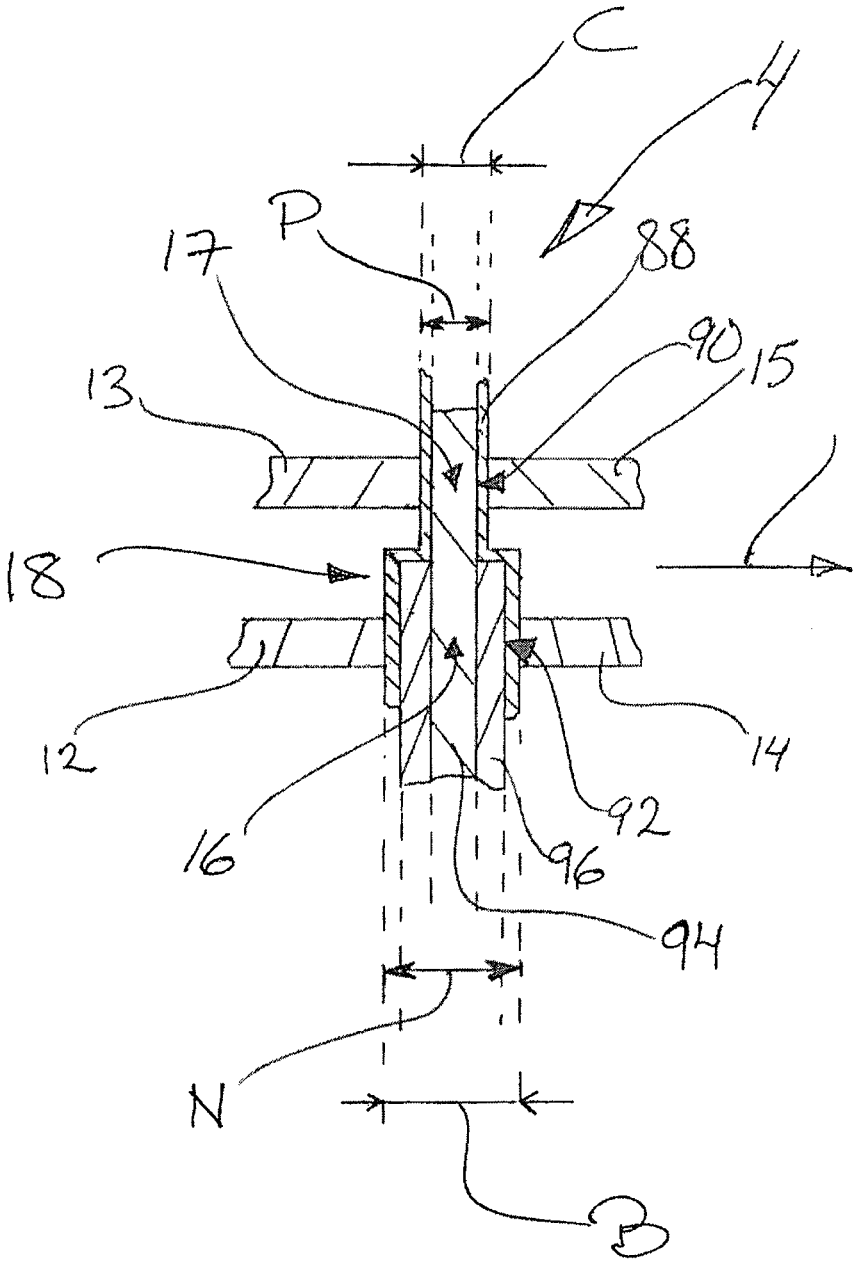
FIG. 5 shows schematically a cross-section of crimping dies of a hand operated crimping tool according to the first embodiment of the invention, shown in a position between the non-crimping position and the crimping position.

FIG. 5 shows schematically a cross-section of crimping dies of a hand operated crimping tool according to the first embodiment of the invention, shown in a position between the non-crimping position and the crimping position.

According to this embodiment, the distances B; C between the respective crimping dies 12, 14; 13, 15 in at least two die pairs 16; 17 are arranged adjustable independently of each other by that at least one crimping die 14, 15 in each of the die pairs 16, 17 is arranged separately adjustable by a separate adjusting mechanism arranged at the tool head 4, as mentioned above, the crimping tool thus being adaptable to workpieces 18 with at least two cross-sectional dimensions N, P where the at least two cross-sectional dimensions N, P may be of different combinations.

The workpiece 18 to be crimped shown in FIG. 5 is an open barrel connector 88 which is to be crimped at two positions 90, 92 having different cross-sectional dimensions to a conductor 94 where the connector 88 at one position 90 encloses the conductor 94 only and at the other position 92 encloses both the conductor 94 and the isolation 96 surrounding the conductor 94.

The mechanism 58 connecting the handles 8, 10 and the tool head 4 has been shown as a toggle mechanism in the embodiments above, but may also be another mechanism which in a similar way connects the movement of the at least one pivotable handle and the movement of the tool head, such as e.g. a cam mechanism or a toothed wheel mechanism.

It is also optionally possible in other embodiments to arrange one of said handles 10 fixed to the body 6 and the other of said handles 8 pivotally to the body 6. In such an embodiment, the relative movement of the tool handles 8, 10 is connected to the relative movement of crimping dies 12, 14; 13, 15 forming a die pair 16; 17 in which at least one workpiece 18 is arranged to be crimped e.g. by that the movement of the pivotally to the body arranged handle 8 is connected to the relative movement of a movable crimping die 14, 15. Referring to the embodiment shown in FIG. 1, this could be accomplished by removing the toggle 42 and fixing the handle 10 to the body 6.

It is also optionally possible in other embodiments to arrange a movable body and to arrange one or both of said handles pivotally to the body 6.

Thus, at least one handle 8, 10 is movably arranged in relation to the body 6. Further, the at least one movably arranged handle 8, 10 is preferably pivotally arranged to e.g. the body 6 or the head 4.

The invention has been shown arranged in a crimping tool having a closed head, but it is possible in other embodiments to arrange the invention in a crimping tool having an open head, or a head that may be adjusted between an open head position and a closed head position. Crimping tools of the above mentioned kind may be arranged with an open head or a closed head. In a tool having an open head, the head has to be much stronger than in a tool having a closed head in order to withstand the same amount of maximum crimping force, this due to that an open head design is less rigid than a closed head design and will flex more easily during crimping.

A crimping tool with a closed head will thus be lighter than a crimping tool with an open head designed for the same amount of maximum crimping force if the crimping tools are made of the same material, this resulting in less load on the user.

A crimping tool with an open head shows on the other hand the advantage that it is possible to e.g. crimp together the ends of two very long wires and thereafter to remove the crimping tool away from the crimped wires without having to pull the crimped wires through the head of a crimping tool as in a tool having a closed head. Further, if the "non-crimped" ends of the two crimped wires are not free which e.g. is the case when these ends already are fixed to e.g. a respective electrical distribution box, it is impossible to remove the crimped wires after crimping from a tool having a closed head.

The features of the embodiments discussed above may be combined in further ways than those explicitly described in the embodiments above.

What is claimed is:

1. Hand operated crimping tool comprising:

a body arranged between a distal end and a proximal end of the crimping tool, a tool head arranged distally on the crimping tool, and handles arranged proximally on the crimping tool, wherein the handles are movably arranged in relation to each other, and wherein at least one of the handles is movably arranged in relation to the body; and two crimping dies between which at least one workpiece is to be crimped, wherein the crimping dies form a die pair, and wherein the relative movement of the tool handles is connected to relative movement of the crimping dies; and wherein the crimping tool includes at least three crimping dies, wherein the at least three crimping dies form at least first and second die pairs, wherein distances between the at least three crimping dies are adjustable independently of each other; and wherein the hand operated crimping tool further comprises separate adjusting mechanisms arranged at the tool head, wherein the adjusting mechanisms are configured to adjust respective adjustable crimping dies wherein each adjusting mechanism comprises an adjusting screw arranged to adjust the position of the respective adjustable crimping die (14, 15), and wherein the adjusting screws are arranged at the tool head.

2. Hand operated crimping tool according to claim 1, wherein at least one of the handles is pivotally arranged.

3. Hand operated crimping tool according to claim 1, wherein at least one crimping die in each of the die pairs is separately adjustable.

4. Hand operated crimping tool according to claim 1, wherein each respective adjusting screw is, in an axial direction of the respective adjusting screw, arranged axially fixed and angularly freely movable to the tool head.

5. Hand operated crimping tool according to claim 1, wherein each respective adjusting screw is arranged to adjust the position of a respective adjustable crimping die by adjusting the position of a respective adjusting element.

6. Hand operated crimping tool according to claim 5, wherein each of the adjusting screws is arranged in a threaded hole arranged in the respective adjusting element, which respective adjusting elements are further connected to the respective adjustable crimping die at a die face facing away from the other crimping die in the respective die pair by mechanically interlocking guiding recesses arranged in the respective adjusting element and the respective adjustable crimping die.

7. Hand operated crimping tool according to claim 5, wherein each of the respective adjustable crimping dies is slidably guided in the tool head in an axial direction of the crimping tool, and the respective adjusting elements are arranged slidably guided in the tool head in the axial direction of the respective adjusting screw.

8. Hand operated crimping tool according to claim 5, wherein the respective adjusting screws extend at an angle to the extension of the respective guiding recesses, whereby rotation of the respective adjusting screw is transferred to translation of the respective adjustable crimping die via translation of the respective adjusting element.

9. Hand operated crimping tool according to claim 1, wherein the respective adjusting screws are, seen in an axial direction of the respective adjusting screw, arranged axially fixed and angularly freely movable to a respective adjusting element, and each adjusting screw is arranged in a threaded hole arranged in the tool head, and each respective adjusting screw is arranged to adjust the position of a respective adjustable crimping die by adjusting the position of a respective adjusting element, and the respective adjusting elements are connected to the respective crimping die at a die face facing away from the other crimping die in the respective die pair by mechanically interlocking guiding recesses arranged in the respective adjusting element and the respective crimping die.

10. Hand operated crimping tool according to claim 1, wherein the relative movement of the tool handles is connected via a mechanism to relative movement of crimping dies forming a die pair.

11. Hand operated crimping tool according to claim 1, wherein the relative movement of the tool handles is connected to relative movement of the crimping dies, and wherein the relative movement of the tool handles is connected to relative movement between the tool head and the body.

12. Hand operated crimping tool according to claim 1, wherein at least one of the handles is pivotably attached to the body.

13. Hand operated crimping tool according to claim 12, wherein the tool head includes a head guiding part arranged to extend along the body and being slidably attached to the body by pins arranged to slide in respective slots extending axially along the tool, and wherein the pivotally attached handle is connected to the head guiding part by a mechanism that is attached to the head guiding part, and wherein the mechanism is arranged to move a distal end of the tool head toward the body when the tool handles are moved toward each other.

14. Hand operated crimping tool according to claim 13, wherein the mechanism is a toggle mechanism, and wherein the handles are connected to the head guiding part by respective toggles which are pivotably attached to the head guiding part and a respective handle at pivot points.

15. Hand operated crimping tool according to claim 1, wherein at least two of the handles are pivotably attached to the body.

16. Hand operated crimping tool according to claim 1, wherein at least one return spring is arranged to move the handles apart when a force pressing the handles toward each other is released, thus moving the distal end of the tool head away from the body.

17. Hand operated crimping tool according to claim 1, wherein the body includes two body parts between which a head guiding part is arranged to slide.

* * * * *